US005339527A

United States Patent [19]

Clemens, Jr.

[11] Patent Number: 5,339,527

[45] Date of Patent: Aug. 23, 1994

[54] WRECKING TOOL II

[76] Inventor: Richard W. Clemens, Jr., 7100 Westwind Dr., Bowie, Md. 20715

[21] Appl. No.: 964,968

[22] Filed: Oct. 22, 1992

[51] Int. Cl.[5] ..... B26B 3/00

[52] U.S. Cl. ..... 30/299; 30/314; 7/161

[58] Field of Search ..... 30/298, 299, 314, 344; 7/144, 161; 403/265-268; D8 DIG. 1, DIG. 7; 16/125

[56] References Cited

U.S. PATENT DOCUMENTS

| | | | |
|---|---|---|---|
| D. 208,997 | 10/1967 | Anderson | D8/10 |
| 676,961 | 6/1901 | Parks | 7/161 |
| 1,875,612 | 9/1932 | Johnson | 30/314 |
| 2,017,369 | 10/1935 | McGhee | 7/161 |
| 3,921,288 | 11/1975 | Clemens, Jr. | 30/314 |
| 4,208,793 | 6/1980 | Sinnott | 30/299 |
| 4,281,943 | 8/1981 | Viennot | 403/266 |
| 5,095,623 | 3/1992 | Williams | 30/299 |

*Primary Examiner*—Eugenia Jones
*Assistant Examiner*—Hwei-Siu Payer
*Attorney, Agent, or Firm*—Howard L. Rose

[57] ABSTRACT

A wrecking tool has a head and a pole; the head including a sleeve for receiving the pole, a crescent shaped head member and a shank generally rectangular in cross section and having an outwardly bowed sharpened edge primarily for ripping into ceilings, the shank flaring laterally outward as it approaches the sleeve to provide additional strength in this region and the interior of the sleeve having an inward taper to its opening partially adjacent the flared region of the shank with the pole held in the sleeve by a cementing material, such as an epoxy resin and a rivet passing only through one surface of the sleeve and into the pole. A D-shaped handle has a sleeve into which the pole is cemented and riveted if the pole is less than eight feet long; the cross member of the D-shaped handle being an I-beam in cross-section.

7 Claims, 2 Drawing Sheets

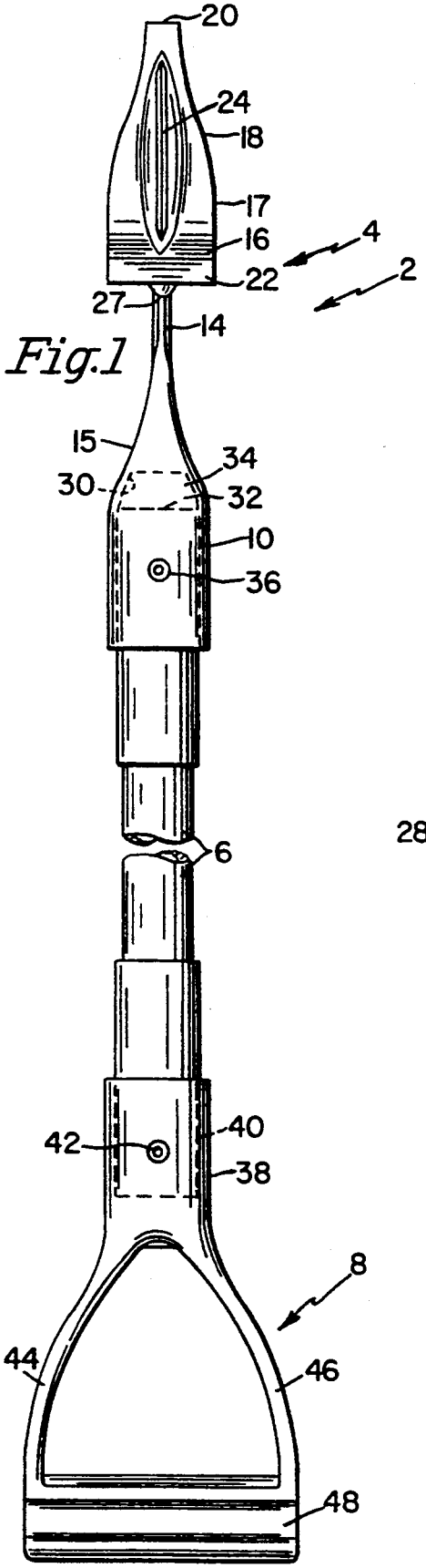
Fig.1
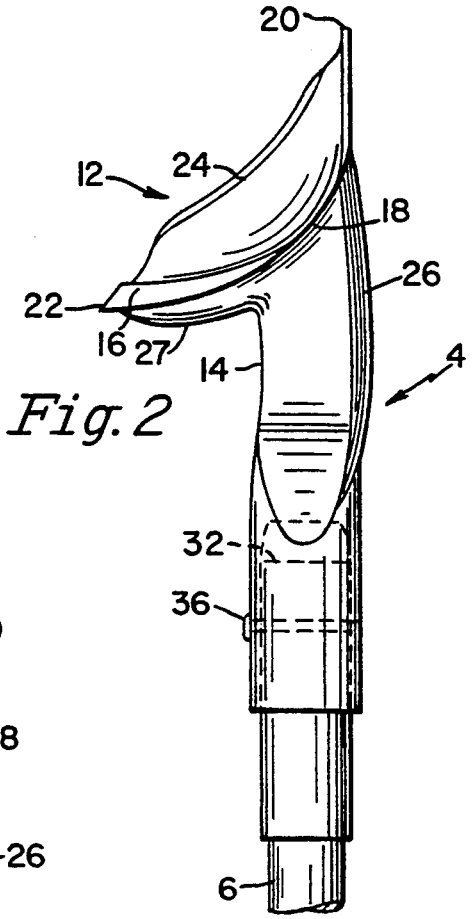
Fig.2
Fig.3
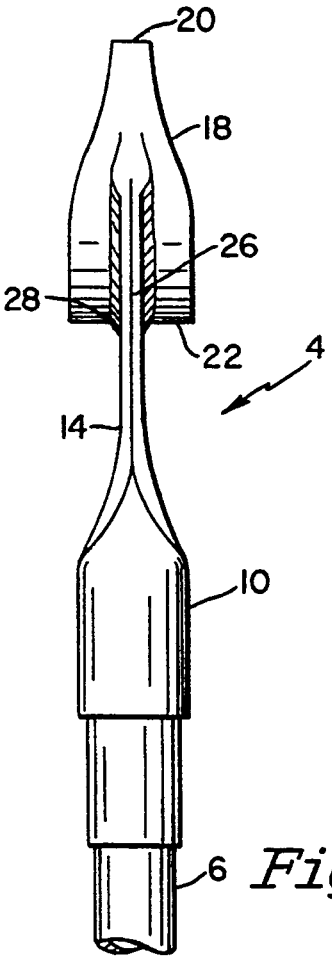
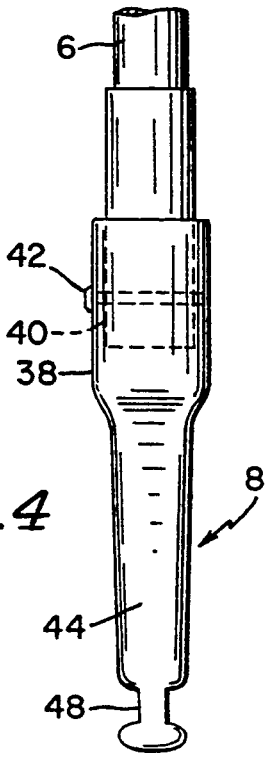
Fig.4

WRECKING TOOL II

The present invention relates to wrecking tools and more particularly to wrecking tools used by firefighters for piercing walls and ceilings.

BACKGROUND OF THE INVENTION

The present invention relates to improvements in my prior U.S. Pat. No. 3,921,288. That which is common in said patent to the present invention is incorporated herein by reference. Since the issuance of that patent certain changes that have been made and in use for some time. Specifically the wooden pole has been replaced with a fiberglass pole having luminescent material embedded in the pole and the previously sharp end designated in the patent by the reference numeral 30 has been blunted. The luminescent pole is employed to permit ready location of the tool in dark areas when the user has had to put the tool down, as well as assist in identifying the area where the tool is chopping. The blunted end or the head has been found to be more effective in making holes in walls and ceilings.

The wrecking tool of the patent sold under the name "Clemens Hook", although in wide use, has been found not to be ideal in certain situations particularly in tearing down ceilings and in some situations requiring maximum torque to produce the desired result. Specifically, the use of the tool as previously constituted would on some occasions cause portions of a ceiling to fall on the individual using the tool. Also in cases involving use of maximum leverage force, the pole also on rare occasions would break.

OBJECTS OF THE INVENTION

It is an object of the present invention to provide a wrecking tool used previously by firefighters to rip down walls, ceilings and doors wherein the tool is modified so that when used to rip down a ceiling the debris falls safely away from the user.

Still another object of the present invention is to provide a wrecking tool for firefighters in which the area of a ceiling destroyed may be more carefully controlled than is so with the prior tool discussed herein.

It is yet another object of the present invention to provide a wrecking tool equally effective in tearing down ceilings as well as walls.

Still another object of the present invention is to provide a wrecking tool that can chop through sheet metal walls or through metal walls of moderate thickness.

It is another object of the present invention to provide interconnection between the head and pole handle of a wrecking tool such that failure of the interconnection between these elements is minimized.

BRIEF DESCRIPTION OF THE PRESENT INVENTION

The basic structure of the wrecking tool of the present invention has an overall configuration basically the same as in the prior patent. The working member of the tool has a sleeve in which the pole is inserted, a shank connecting the sleeve to a head that is basically a rectangle terminating in a triangle in plan and a crescent in side view with its transverse centerline at an angle of about 60° to the sleeve. The crescent is situated on a transversely narrow shank extending between the sleeve and the crescent. The lower end of the crescent has a wide skirt ending at its widest end in a relatively sharp blade and with a web extending from an upper surface of the skirt adjacent the wide end to adjacent the other, blunt and narrow, end of the crescent.

In prior use in order to rip down a ceiling, the tool was swung forward and upward so that the wide skirt of the crescent pierced the ceiling. The tool had the ceiling material trapped between the wide skirt of the head and the shank, the two elements in effect forming a hook. When the tool was yanked back to rip the ceiling material down, this would at times cause the ceiling material to fall on the user. Also the yanking action at times loosened adjacent regions of the ceiling causing them to fall on the firefighters.

In accordance with the present invention a length of the edge of the narrow shank that merges into the narrower end of the crescent, that is, the edge of the shank remote from the skirt of the crescent, is bowed outwardly along the narrow edge and sharpened to provide a cutting tool, essentially an axe. In use the tool is swung at the ceiling with the sharpened shank region as the leading edge. The tool now cuts into the ceiling, driving forward away from the user and pulls down ceiling material on either side of the cut in a region that is relatively narrow. Also since the forward thrust is directed away from the firefighter and the under-surface of the crescent does not contact the ceiling material until somewhat forward of the user danger to the user is lessened.

The use of the tool in this manner is not restricted to use in ripping down ceilings and may be used to penetrate walls, doors or whatever but the primary use of the sharpened shank region is for ripping ceilings or cutting into metal walls. More and more popular, durable exterior walls of this design are being employed and the chopping edge of the shank is a material value in breaching such walls. The edge of the wide end of the crescent is valuable in peeling tin roof or metal walls once breached.

The prior problem of breaking of poles has been found to be the method of connecting the head and the pole. Previously these two elements were interconnected by means of rivets, reference numerals 24 and 26 in FIG. 1 of the prior patent and structure.

In accordance with the present invention, the main holding force of head to pole is provided by an epoxy resin extending along the length of the interface between the sleeve of the head and the pole. In addition a single rivet that extends through one side only of the sleeve and into the pole is provided near the end of the sleeve adjacent the shank. By this approach stress is distributed relatively evenly over the length of the pole in the sleeve and the reliability of the pole is greatly enhanced relative to the two, totally piercing rivets of the prior structure. The same approach is used for the connection of a handle to the pole.

The above and other features, objects and advantages of the present invention, together with the best means contemplated by the inventor thereof for carrying out his invention will become more apparent from reading the following description of a preferred embodiment and perusing the associated drawings in which:

BRIEF DESCRIPTION OF THE DRAWINGS

FIG. 1 is a front view in elevation of the wrecking tool of the present invention;

FIG. 2 is a side view in elevation of the wrecking tool of the present invention;

FIG. 3 is a detailed view in elevation of the sharpened shank of the head of the wrecking tool of the present invention;

FIG. 4 is a detailed side view in elevation illustrating the interconnection of the handle and pole of the invention;

DETAILED DESCRIPTION OF THE INVENTION

Figure 5:
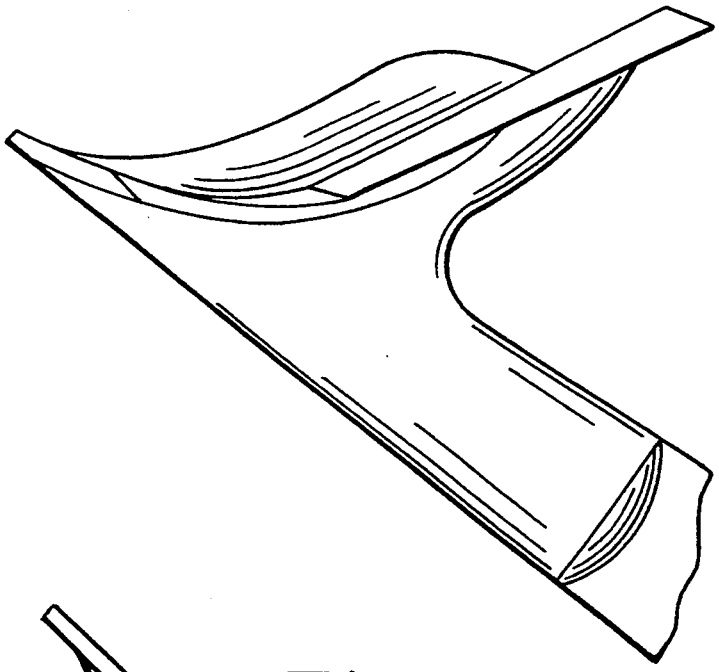
Fig. 5 PRIOR ART
FIG. 5 illustrates the position of entry and start of tearing down action of the tool of the prior invention.

Referring now to FIGS. 1 and 2 of the accompanying drawings, tool 2 comprises three basic elements, a head 4, a pole 6 and a handle 8.

The head 4 is made of a suitable metal such as tempered aluminum or iron and comprises a hollow sleeve 10, a crescent shaped member 12 and a shank 14 interconnecting the member 12 and the sleeve 10.

The member 12 is crescent shaped in its side view and in its top view has generally a rectangular lower region 16, a wide blade region at the exposed end of the rectangular region 16, and an upper, as viewed in FIG. 1, triangular region 17 extending from the internal end of rectangular region 16 to a narrow region 18 at its other end, it in turn terminating in a blunt end 20. It has been found that the blunt end makes a more effective breach than the chisel end of the patent. The blade region 16 terminates in a generally sharp edge 22 also used as a penetrating surface. A reinforcing rib 24 that rises at right angles to and from the curved surface of the crescent shaped member 12 acts as a fulcrum in breaching and spreading material and reducing drag as the tool is forced into the wall or ceiling. Such a rib 24 may also be sharpened to enhance its penetrating effect.

The head 4 is provided with a relatively sharp cutting edge 26 formed on a relatively narrow edge 28 of the shank 14 (see FIG. 3) below the blunt end 20 of the narrow region of the crescent shaped member 12. The cutting edge 26 is bowed out about ¼ inch and is ground or otherwise to a sharp edge that protrudes about a 1/16 inch at its maximum point of bulge. The shank 14 is flared outwardly in a region 15 commencing at about the middle of the shank to the sleeve to add strength to the shank, particularly at the end of the pole region.

The sleeve 10 is no longer split as in the patent and is tapered internally as at numeral 30, to reduce stresses in the sleeve at the end of the internal channel. An epoxy resin generally designated by reference numeral 34 is disposed between the end 32 of pole 6 and sleeve 10 and cured to securely hold the pole in the sleeve. To further assist in this function a rivet 36 extends through one surface only of the sleeve 10 and through the pole 6. The use of the rivet is primarily to provide a backup in case the resin is stressed or heated to the point of fatigue and failure.

The handle 8 is similarly attached to the pole 6. The handle, a D-shaped member 8, is formed on the end of a sleeve 38. The sleeve 38 is secured to the pole 6 by epoxy resin generally designated by reference numeral 40 and reinforced by a rivet 42. The handle 46 is large enough to permit three men to operate the tool at the same time, each of two men grasping side members 44 and 46 of the handle and a third man grasping cross member 48. The cross-member 48 of the handle is in the form of an I-beam in cross section for adding strength. If the pole 6 is longer than six feet a D-handle is not used since enough pole is available for three men to use.

As stated in said prior patent the tool described herein is capable of performing many of the functions of standard boat hooks, Halligan hooks, Halligan bars, and pike poles. In fact, this invention performs many of the same functions in a more efficient manner. For example, the standard pike pole when used to remove wall or ceiling material creates a small slit when initially inserted. A quarter turn is then required to pull off the surface, the width of the crescent providing this function. The tool of this invention creates a much larger initial hole in the material and no turning is required to remove a large segment of the wall or ceiling surface. Furthermore, this invention permits ready removal of today's modern wall and ceiling materials which, in many cases, have been greatly increased in strength due to changes in the building codes and standards. In addition and as previously indicated, the wrecking tool of the present invention, provides a tool in which the blunt end 20 breaches a ceiling, for instance, and the blade 26 rips through the material forward of the entry point pulling down material while moving away from the user.

With the addition of the blade 26 there are now five surfaces for breaching (parting) walls, ceilings, doors, etc., these surfaces being designated by reference numerals 27, 20, 22, 24 and 26, plus side edges of the head.

Referring to FIG. 5 of the accompanying drawings, the use of the prior wrecking tool in pulling down a ceiling is illustrated. The edge 22 of the tool penetrates the ceiling and the underside of the crescent, the underside of the region 16 as designated in FIG. 1 contacts the ceiling basically above the head of the firefighter. He can move back but because one must pull down on the pole to pull down the ceiling, the user cannot be far removed from under this region of contract. Repeatedly yanking down on the pole can bring down material all around the user and possibly produce injury.

Figure 6:
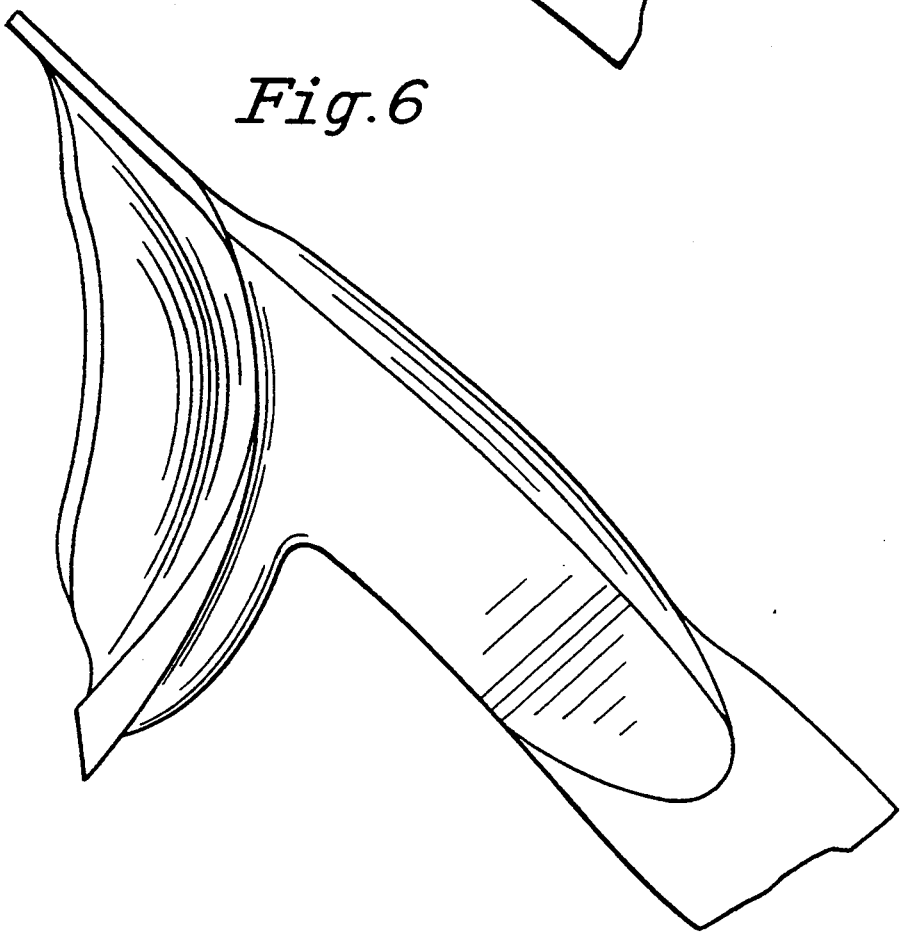
FIG. 6 illustrates the position of entry and tearing down action of the tool of the present invention.

Referring to FIG. 6, the underside of the crescent of the tool of the present invention contacts the ceiling forward of the user and the area that is forced down due to the cut through the ceiling by the edge surface 26 is restricted to a lesser area than with the prior tool. Also repeated swings of the tool produce loosening of the ceiling forward of the user and since the area affected by the tool is less wide than with the prior tool there is less danger of failure of large areas of the ceiling.

It should be noted that the members 72 and 74 of FIG. 1 of the prior patent have been removed to improve the penetrability of the tool. Specifically the only protrusion from the shank is the rivet head 36 but this is not on a penetrating, i.e. side surface of the shank and therefore will not impede entry of the shank into a breach.

While one embodiment of the invention has been described in detail, it will be apparent to those skilled in the art that the disclosed embodiment may be modified. Therefore, the foregoing description is to be considered exemplary rather than limiting, and the true scope of the invention is that defined in the following claims.

What is claimed is:

1. A wrecking tool comprising a pole, a sleeve for receiving said pole, a head member generally crescent shaped in side view, a shank interconnecting said sleeve and said head member, said head member lying at an acute angle relative to said shank such that the head member has upper and lower ends with respect to said shank held vertically, an edge of said shank remote from said lower end of said head member having a sharp edge extending away from said lower end of said crescent shaped member, said edge of said shank being bowed outwardly to provide an outwardly extending blade, said pole secured in said sleeve by a cementing material, and a rivet extending through one surface only of said sleeve into said pole.

2. A wrecking tool according to claim 1 further comprising a D-shaped handle having a sleeve for receiving said pole, said handle being secured to said pole by a cementing material and a rivet extending through one side only of said handle and into said pole.

3. A wrecking tool according to claim 2 wherein said handle is a D-shaped member in plan, said handle has a cross member and two side members, and said cross member is I-beam shaped in cross section.

4. A wrecking tool according to claim 1 wherein said shank has a longitudinal axis, and is generally rectangular in cross-section and is narrow transverse to the plane of a longitudinal axis of the crescent shaped member, said shank flaring outwardly toward said sleeve from its narrow dimension.

5. A wrecking tool according to claim 4 wherein said shank provides essentially smooth, uninterrupted side surfaces between said sleeve and said head member.

6. A head for a wrecking tool comprising, a sleeve for receiving a pole, a head member generally crescent shaped in side view, and a shank interconnecting said sleeve and said head member, said head member lying at an acute angle relative to said shank whereby said crescent shaped head member has upper and lower ends with respect to said shank held vertically, an edge of said shank remote from said lower end of said head member having a sharp edge extending away from said lower end of said crescent shaped member, said edge of said shank being bowed outwardly to provide an outwardly extending blade.

7. A head for a wrecking tool according to claim 1 wherein said sleeve has an internal cylindrical hollow region for receiving a pole, said hollow region terminating in an inwardly tapered region that coincides with the outwardly bowed edge of said shank.

* * * * *